US005404660A

United States Patent [19]

Webster

[11] Patent Number: 5,404,660

[45] Date of Patent: Apr. 11, 1995

[54] MECHANISM FOR SUPPORTING AN EARTHWORKING ETC. TOOL

[75] Inventor: Ian F. Webster, Mossborough, England

[73] Assignee: Webster Equipment Limited, Rotherham, England

[21] Appl. No.: 962,219

[22] PCT Filed: May 18, 1992

[86] PCT No.: PCT/GB92/00891

§ 371 Date: Mar. 4, 1993

§ 102(e) Date: Mar. 4, 1993

[87] PCT Pub. No.: WO92/20875

PCT Pub. Date: Nov. 26, 1992

[30] Foreign Application Priority Data

May 18, 1991 [GB] United Kingdom ..... 9110798

[51] Int. Cl.[6] ..... E02F 3/76; E02F 3/36

[52] U.S. Cl. ..... 37/189; 37/403; 37/411; 414/718; 299/67; 299/89; 404/117; 404/128; 175/327; 172/247; 172/250

[58] Field of Search ..... 37/403, 468, 404, 405, 37/406, 189, 443, 347, 364, 91, 92, 94, 379, 117.5, 66.118; 414/722, 723, 724, 727, 716, 718, 720; 172/272, 247, 245, 250–254; 299/66, 67, 68, 89; 404/116, 117; 175/327, 329

[56] References Cited

U.S. PATENT DOCUMENTS 4,355,477 10/1982 Holmgren et al. ..... 37/403
4,602,821 7/1986 Schaeff ..... 37/403 X
4,825,567 5/1989 Andiano et al. ..... 37/403 X
4,942,682 7/1990 McDowell ..... 37/189 X
4,962,597 10/1990 Kutra et al. ..... 37/403
5,244,306 9/1993 Artzberger ..... 37/403 X

FOREIGN PATENT DOCUMENTS 3411866 10/1985 Germany ..... 37/468

*Primary Examiner*—Randolph A. Reese
*Assistant Examiner*—Robert Pezzuto
*Attorney, Agent, or Firm*—Trexler, Bushnell, Giangiorgi & Blackstone, Ltd.

[57] ABSTRACT

A mechanism (22) for supporting an earthworking tool from a vehicle such as a front end-loader (21) includes: (i) a primary support structure (23) adapted to be pivotally attached, in a readily releasable manner, about a generally upright, slewing axis (24), to a conventionally-provided elevating linkage mechanism (25) of a vehicle; (ii) power driver (26,27) to effect controlled slewing of the primary support structure (23) about its slewing axis (24); (iii) a secondary support structure (28) rotatably mounted about a generally forwardly directed axis (29) on the primary support structure (23); (iv) power driver (30) to effect controlled rotation of the secondary support structure with respect to the primary support structure; (v) tool support (32) pivotally mounted on the secondary support structure (28); and (vi) driver (33) to pivot the tool support with respect to the secondary support structure.

18 Claims, 9 Drawing Sheets

MECHANISM FOR SUPPORTING AN EARTHWORKING ETC. TOOL

BACKGROUND OF THE INVENTION

This invention relates to a mechanism for supporting an earthworking tool (such as a bucket loader or a rotary cutting head) from a vehicle (such as a tractor or track-laying vehicle).

Existing vehicles, known as "front end-loaders", which may be wheeled or track-laying, are provided with a fixed arm, having vertical movement, which carries a bucket, the bucket being provided with rotary movement for tipping.

It would clearly be advantageous if such a vehicle could be adapted for multiple uses, by having an ability to mount a plurality of tool types for different earthworking operations either above ground (such as trenching, floor/road planing, bankside excavation, spoil loading/tipping) or underground operations (such as the driving of civil engineering tunnels or of mine roadways), with minimum downtime for tool changing operations.

A basic object of the present invention is to provide a mechanism for supporting on a front end-loader an earthworking tool exhibiting improved characteristics over prior art proposals.

SUMMARY OF THE INVENTION

According to a first aspect of the present invention there is provided a mechanism for supporting an earthworking tool from a vehicle such as a front end-loader, comprising;

(i) a primary support structure adapted to be pivotally attached, in a readily releasable manner, about a generally upright, slewing axis, to a conventionally-provided elevating linkage mechanism of a vehicle;

(ii) power means to effect controlled slewing of the primary support structure about its slewing axis;

(iii) a secondary support structure rotatably mounted about a generally forwardly directed axis on the primary support structure;

(iv) power means to effect controlled rotation of the secondary support structure, with respect to the primary support structure;

(v) tool support means pivotally mounted on the secondary support structure; and (vi) means to pivot the tool support means with respect to the secondary support structure.

The power means to effect slewing may consist of a double acting hydraulic ram, or a pair of single acting rams, while the power means to effect rotation of the secondary support structure with respect to the first may comprise an hydraulically powered linear actuator.

The tool support means may be provided with means to readily attach various equipment to the mechanism such as, in one instance, a detachable, drum or disc carrying cutter-picks for cutting or extracting material.

Power means may also be provided to pivot the secondary support structure with respect to the primary support structure about a generally horizontal axis, said power means may consist of a double acting hydraulic ram, or a pair of single acting rams.

Lugs may be provided on the secondary support structure to engage corresponding lugs on a bucket so that the bucket may be picked up by utilising the movements of the mechanism thus eliminating the need to lift and bolt the bucket in place.

Other types of tools which may be attached to the secondary support structure include a bore hole drilling unit or a hydraulic hammer.

According to a second aspect of the present invention there is provided a vehicle provided with the mechanism of the first aspect.

BRIEF DESCRIPTION OF THE DRAWINGS

The invention will now be described, by way of example, with reference to the accompanying drawings in which.

DETAILED DESCRIPTION OF THE ILLUSTRATED EMBODIMENT

Figure 3:
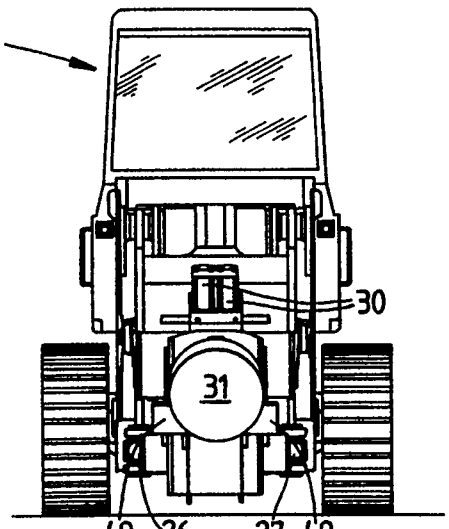
FIG. 3 is a front view of the mechanism and front end-loader of FIG. 1.
Figure 2:
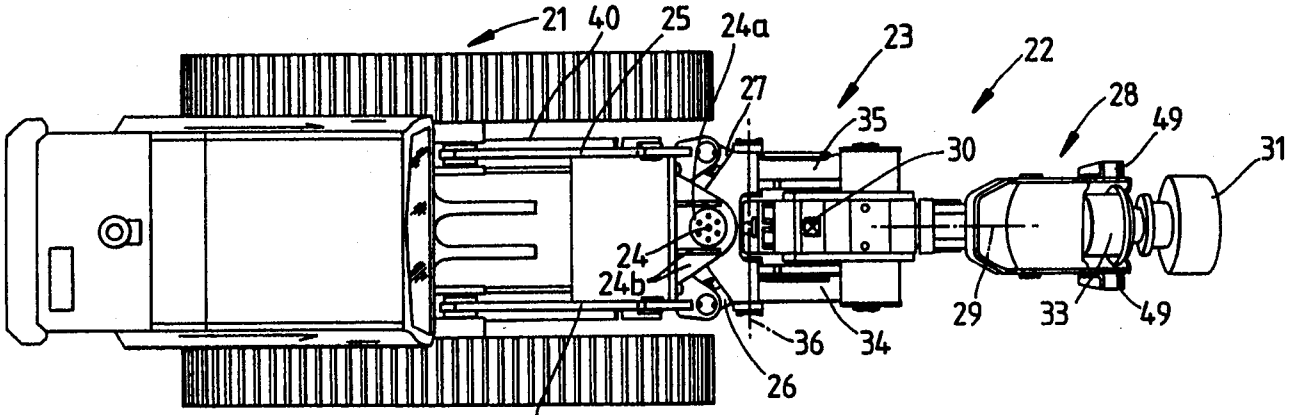
FIG. 2 is a plan of the mechanism and front end-loader of FIG. 1.
Figure 1:
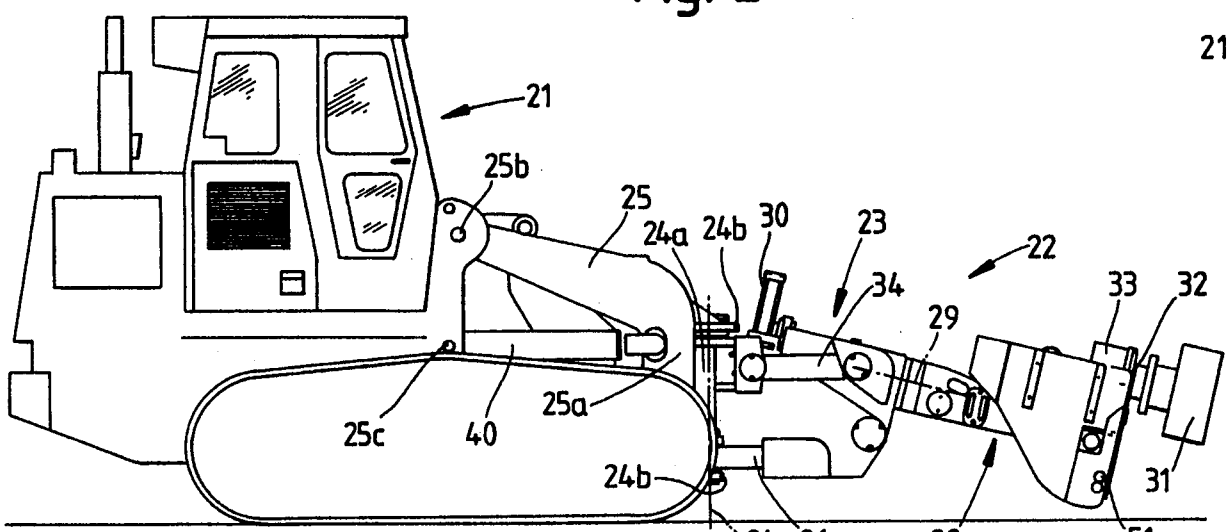
FIG. 1 is a side elevation of the mechanism supported on a front end-loader and carrying a cutter drum.

In FIGS. 1 to 4 a track-laying front end-loader vehicle 21 is provided with a mechanism 22 for supporting an earthworking tool to be described in detail later.

The mechanism 22 comprises a primary support structure 23 includes a king post 24*a* attached about a generally upright, slewing axis 24 to a conventionally-provided elevating linkage mechanism 25 of the vehicle 21, operable by a pair of hydraulic rams 40. Power means to effect controlled slewing is provided by a pair of single acting rams 26 and 27, and with a secondary support structure 28 rotatably mounted about a generally forwardly directed axis 29 on the primary support structure 23. Further power means to effect controlled rotation of the secondary support structure 28 with respect to the primary support structure 23 is provided by an hydraulically powered linear actuator 30. An earthworking tool in the form of a detachable cutter drum 31 is illustrated, being attached to tool support means 32 pivotally mounted on the secondary support structure 28, and means 33 is provided to pivot the tool support means 32 with respect to the secondary support structure 28.

A further pair of rams 34 and 35 are provided to pivot the secondary support structure 28 with respect to the primary support structure about a horizontal axis 36.

Figure 4:
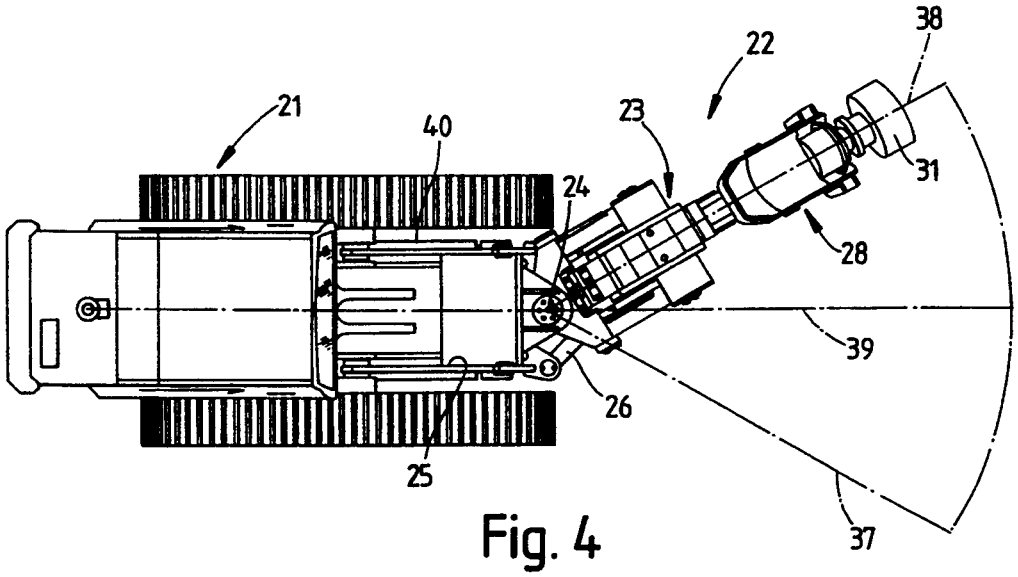
FIG. 4 corresponds to FIG. 2 but shows the mechanism slewed about its slewing axis.

Referring specifically to FIG. 4, actuation of the rams 25 and 26 effect slewing about the slewing axis 24, between positions 37 and 38, up to 30° either side of the central position 39 of the mechanism 22.

Figure 5:
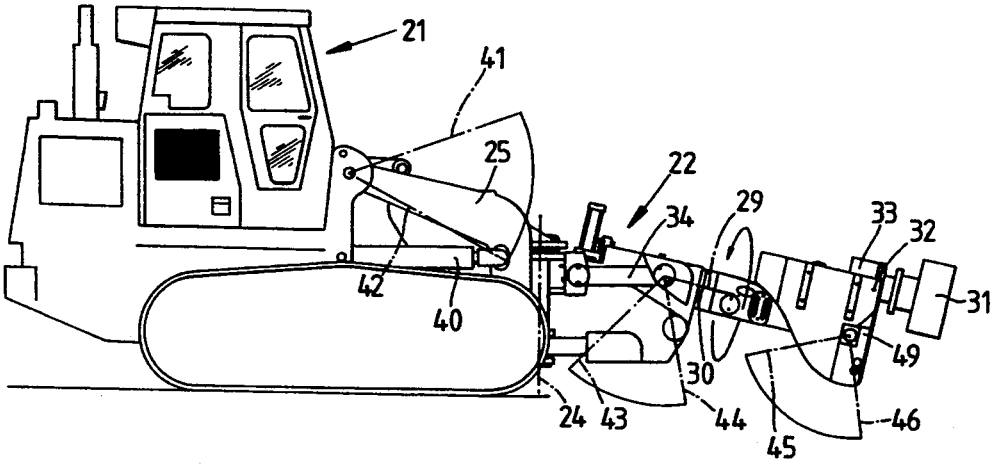
FIG. 5 corresponds to FIG. 1 but shows the various degrees of lift, tilt and rotation of the mechanism.

In FIG. 5 the various degrees of lift, tilt and rotation of the mechanism 22 are shown, where it can be seen that the elevating linkage mechanism 25 provides up to 50° of lift between upper and lower position 41 and 42. Up to 345° of rotation of the secondary support structure 28 about the axis 29 is also provided. Rams 34 and 35 provide up to 54° of tilt of the secondary support structure 28 between near and forward positions 43 and 44. The means 33, preferably hydraulic, provide up to 85° of tilt of the tool support means 32 between rear and forward positions 45 and 46.

Figure 6:
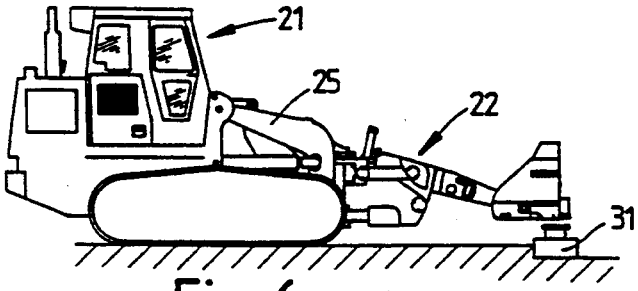
FIG. 6 corresponds to FIG. 1 but shows the mechanism adjusted for floor planing.

In FIG. 6 the linkage mechanism 25 is in its lower position 42, with tool support means 32 tilted towards its rear position 45 and the secondary support structure 28 tilted towards its forward position 44 aligning the cutter drum 31 to effect floor or road planing, as illustrated.

Figure 7:
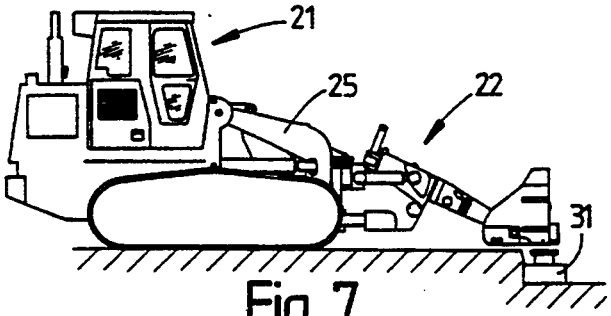
FIG. 7 corresponds to FIG. 1 but shows the mechanism adjusted for cutting below ground level.

In FIG. 7 the secondary support structure 28 is tilted towards its rear position 43 with suitable adjustment of the tool support means 32 towards its forward position 46 aligning the cutter drum 31 to cut below the level of the ground, as illustrated.

Figure 8:
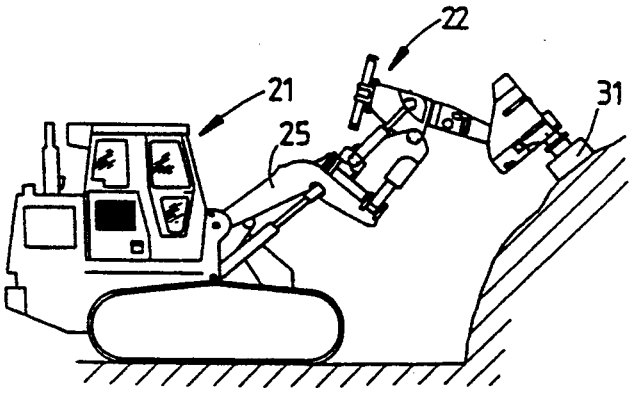
FIG. 8 corresonds to FIG. 1 but shows the mechanism adjusted for bankside excavation.

In FIG. 8 the linkage mechanism 25 is in its upper position 41, the tool support means 32 tilted towards its forward position 46 and the secondary support structure 28 is tilted further towards its rear position 43 to align the cutter drum 31 for bankside excavation, as illustrated. Further adjustment of tilt and lift enables re-alignment of the cutter drum 31 during excavation.

Figure 9:
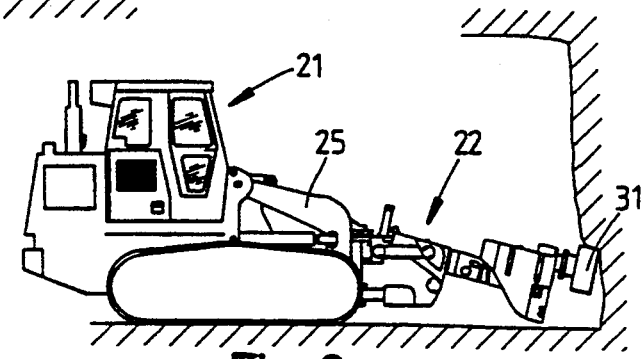
FIG. 9 corresponds to FIG. 1 but shows the mechanism adjusted for tunnelling.

In FIG. 9 the linkage mechanism 25 moves between its lower (shown here) and upper positions with suitable adjustment of the tilt of the tool support means 32 and slewing of the mechanism to effect tunnelling, as illustrated.

Figure 10:
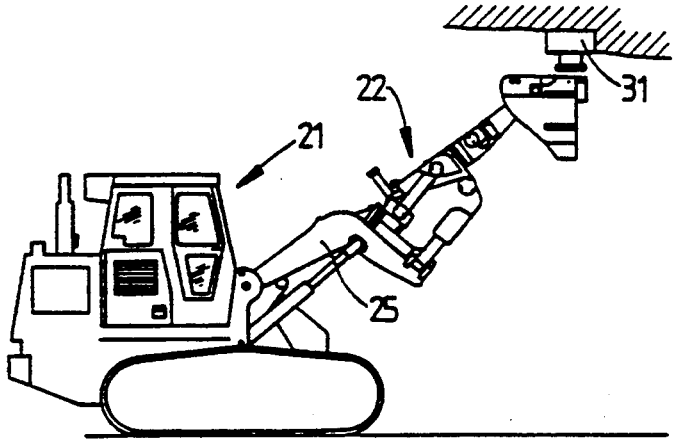
FIG. 10 corresonds to FIG. 1 but shows the mechanism adjusted for tunnel profiling.

In FIG. 10 the linkage mechanism 25 is raised to its upper position 41 and the tool support means 32 suitably aligned in conjunction with controlled slewing to effect profiling of the tunnel, as illustrated.

Figure 11:
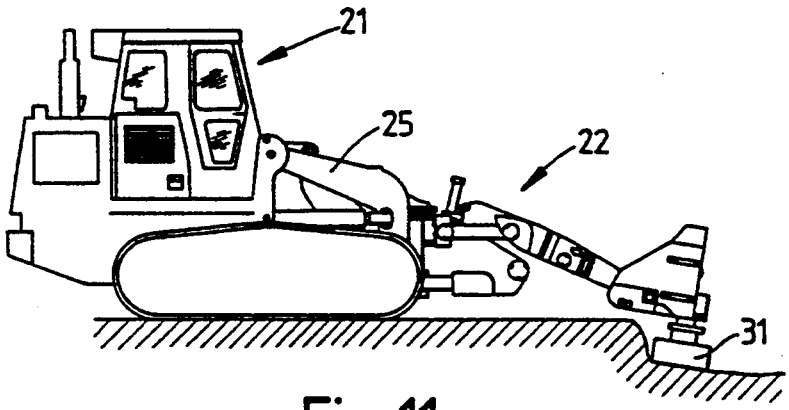
FIGS. 11 to 13 correspond to FIG. 1 but show the mechanism variously adjusted for trenching.
Figure 12:
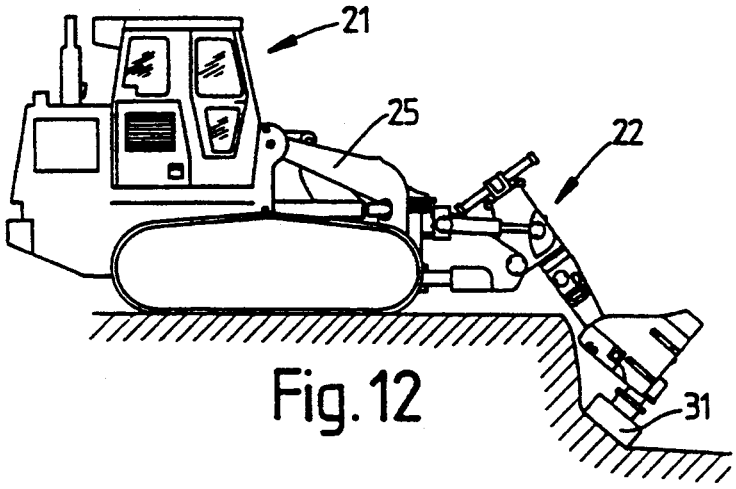
Figure 13:
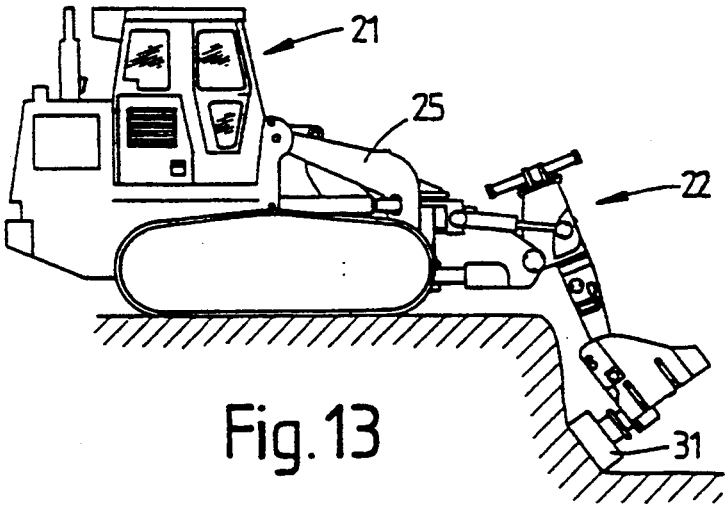

In FIGS. 11 to 13, with linkage mechanism 25 in its lower position 42, various degrees of tilt of the secondary support structure 28 and the tool support means 32 in conjunction with controlled slewing allow the cutter drum 31 to effect trenching.

Figure 14:
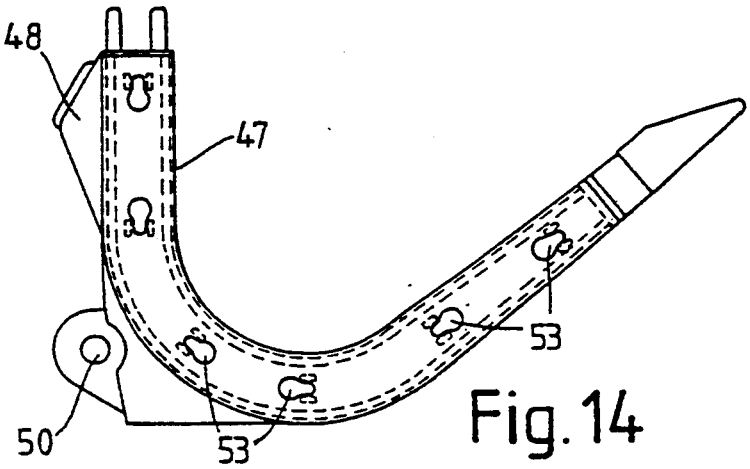
FIG. 14 is a side elevation of a bucket for use with the mechanism.
Figure 15:
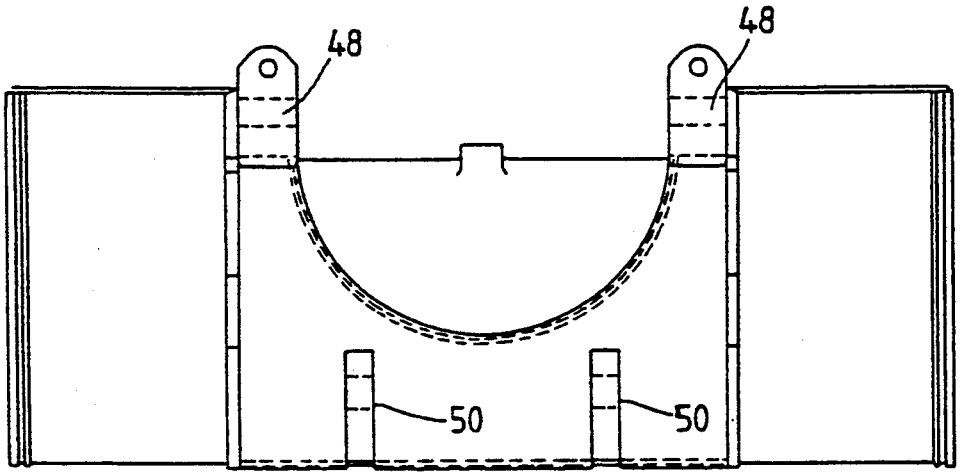
FIG. 15 is a rear elevation of the bucket of FIG. 14.

In FIGS. 14 and 15 an alternative earthworking tool in the form of a bucket 47 is illustrated, having lugs 48 for engagement with corresponding lugs 49 on the secondary support structure 28. A bore 50 is also provided on the bucket for alignment with a corresponding bore 51 on the secondary support structure 28 wherein both bores receive a retaining pin 52 (see FIG. 16). Removable side plates (not shown) may be provided for the bucket 47 and connected thereto with the aid of slots 53. Controlled movement of the mechanism 22 can be used to engage the lugs 48 and pick up the bucket 47 without the need to lift and bolt the bucket 47 in place.

Figure 16:
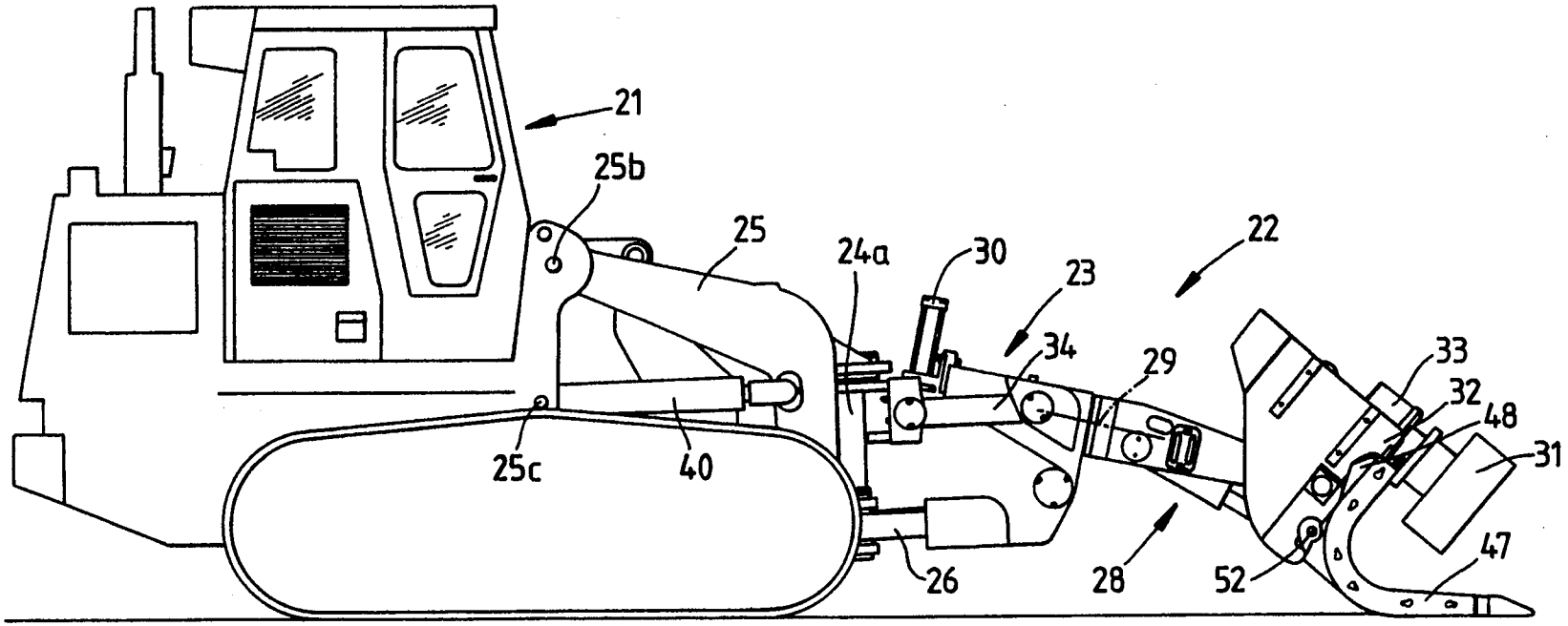
FIG. 16 corresponds to FIG. 1 but shows the bucket of FIG. 14 attached to the mechanism.
Figure 17:
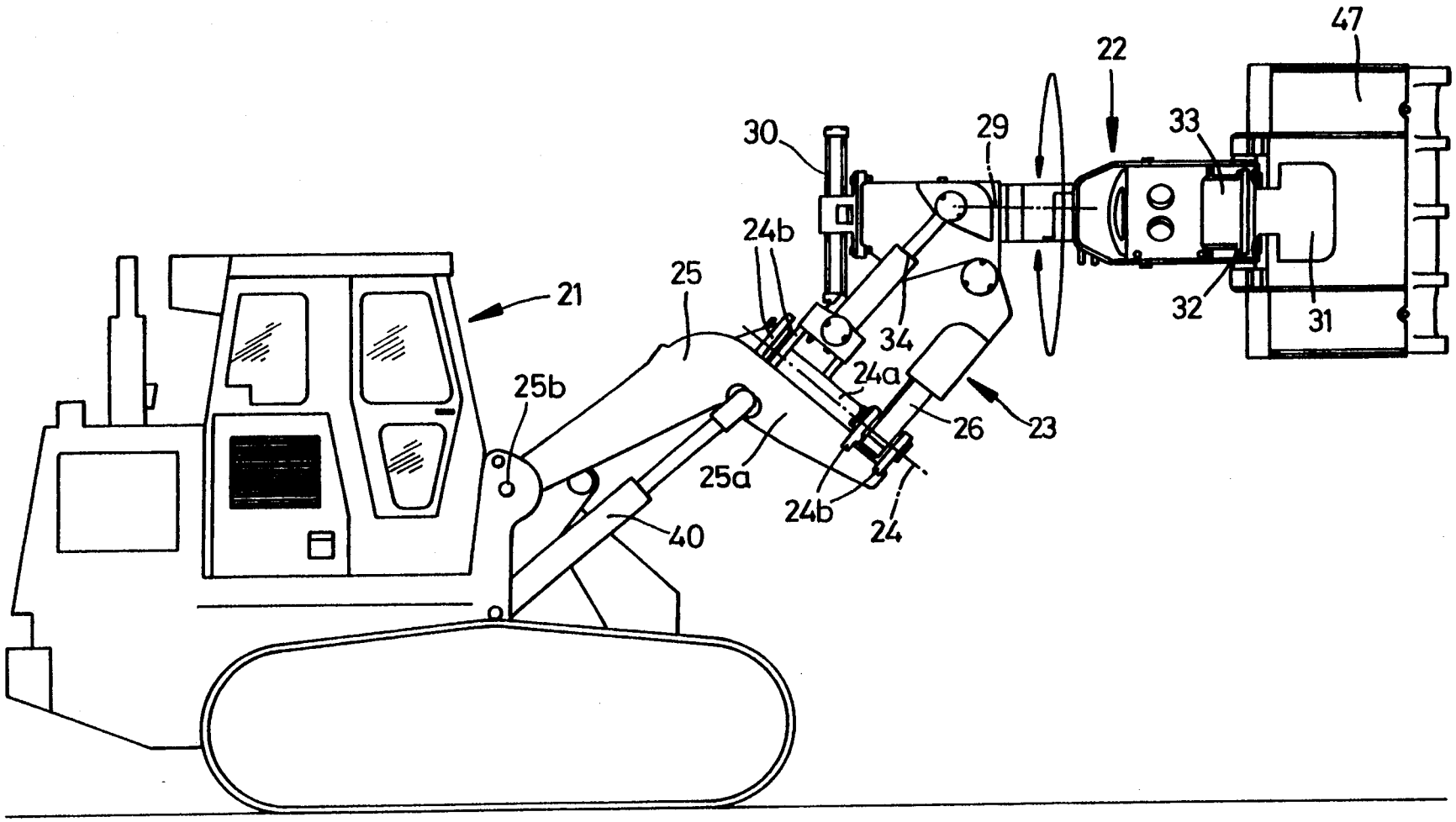
FIG. 17 corresponds to FIG. 16 but shows the mechanism lifted and the secondary support structure rotated to effect side tipping of the bucket.

Referring particularly to FIGS. 16 and 17 it can be seen that the bucket 47 can be loaded and by utilising the lift, tilt and rotational movements of the mechanism 22 the bucket can be raised and emptied.

Figure 18:
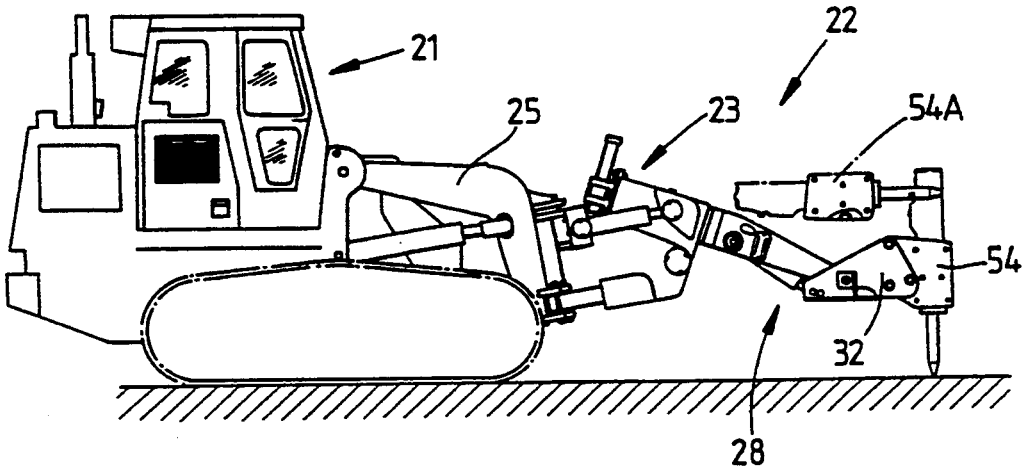
FIG. 18 corresponds to FIG. 1 but shows an hydraulic hammer attached to the secondary support structure.

In FIG. 18 the tool support means is provided with an earthworking tool in the form of an hydraulic hammer 54, shown with the secondary support structure in its rear position 45 and adapted for vertical operation thus, through tilting of the secondary support structure to its forward position 46 the hydraulic hammer 54 is adapted for horizontal operation 54A.

Figure 19:
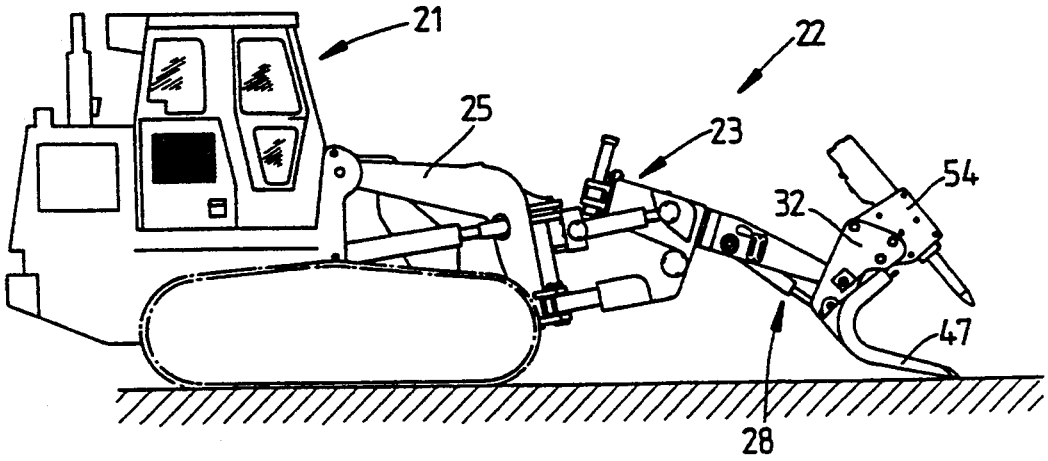
FIG. 19 corresponds to FIG. 18 but shows a bucket attached to the secondary support structure for loading.

FIG. 19 shows a bucket 47 attached to the secondary support structure 28 in the manner described above for subsequent loading and removal of extracted material.

Figure 20:
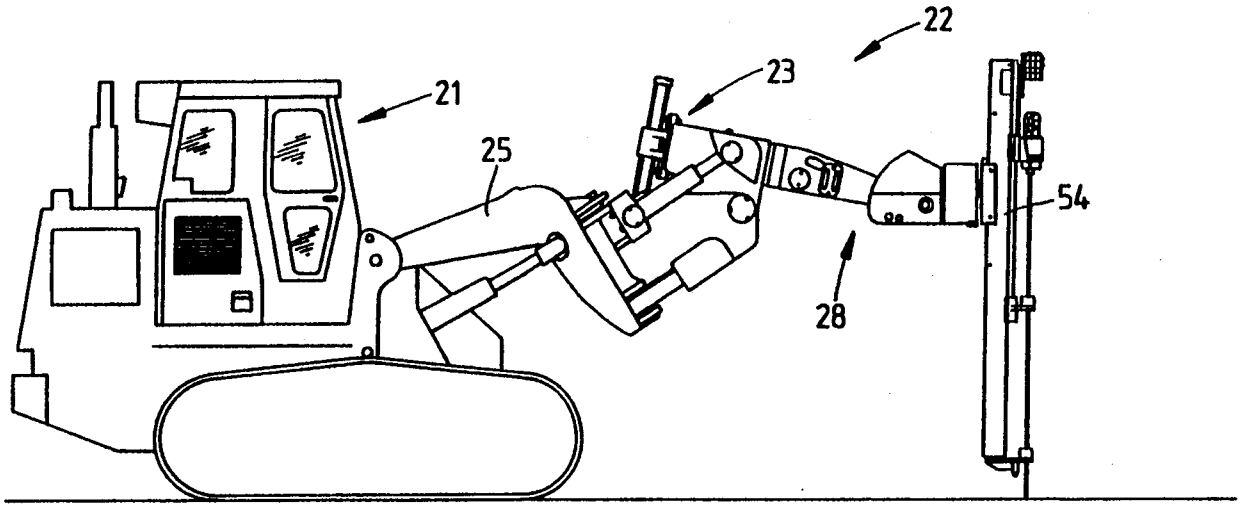
FIG. 20 and 21 correspond to FIG. 1 but show a drill unit attached to the secondary support structure.
Figure 21:
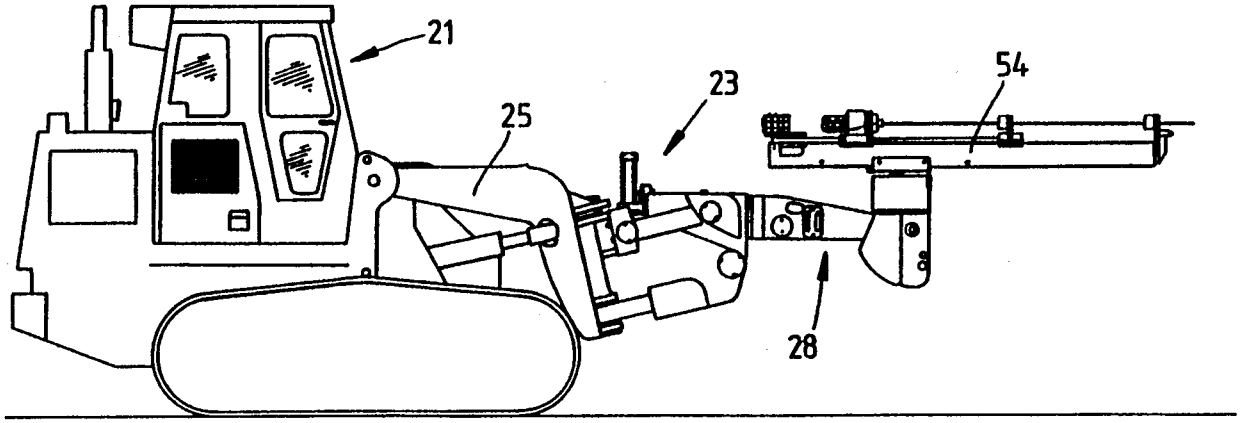

In FIGS. 20 and 21 the tool support means is provided with an earthworking tool in tile form of a drill unit 55 adapted for vertical, horizontal or intermediate drilling, respectively, through a range of positions and heights utilising the lift, tilt and rotational movements of the mechanism 22.

I claim:

1. A mechanism for supporting an earthworking tool from a vehicle comprising:

(i) a primary support structure adapted to be pivotally attached, in a readily releasable manner, about a generally upright, slewing axis, to an elevating linkage mechanism of a vehicle;

(ii) power means for controlled slewing of the primary support structure about its slewing axis;

(iii) a secondary support structure rotatably mounted about a generally forwardly directed axis on the primary support structure;

(iv) power means for controlled rotation of the secondary support structure with respect to the primary support structure;

(v) tool support means pivotally mounted on the secondary support structure; and (vi) means to pivot the tool support means with respect to the secondary support structure.

2. A mechanism for supporting an earthworking tool from a vehicle as claimed in claim 1, wherein the power means to effect slewing consists of a double acting hydraulic ram.

3. A mechanism for supporting an earthworking tool from a vehicle as claimed in claim 1, wherein the power means to effect slewing consists of a pair of single acting hydraulic rams.

4. A mechanism for supporting a earthworking tool from a vehicle as claimed in any preceding claim wherein the power means to effect rotation of the secondary support structure with respect to the first is an hydraulically powered linear actuator.

5. A mechanism for supporting an earthworking tool from a vehicle as claimed in claim 1, wherein the tool support means is provided with means to readily attach various tools to the mechanism.

6. A mechanism for supporting an earthworking tool from a vehicle as claimed in claim 5, wherein a detachable drum or disc carrying cutter picks is attached to the secondary support structure.

7. A mechanism for supporting an earthworking tool from a vehicle as claimed in claim 5, wherein a drilling unit is attached to the secondary support structure.

8. A mechanism for supporting an earthworking tool from a vehicle as claimed in claim 5, wherein an hydraulic hammer is attached to the secondary support structure.

9. A mechanism for supporting an earthworking tool from a vehicle as claimed in claim 1, wherein power means is provided to pivot the secondary support structure, with respect to the primary support structure, about a generally horizontal axis.

10. A mechanism for supporting an earthworking tool from a vehicle as claimed in claim 9, wherein the power means consists of at least one hydraulic ram.

11. A mechanism for supporting an earthworking tool from a vehicle as claimed in claim 1, wherein lugs are provided on the secondary support structure to engage corresponding lugs on a bucket.

12. A vehicle provided with a mechanism for supporting an earthworking tool which mechanism comprises:

(i) a primary support structure adapted to be pivotally attached, in a readily releasable manner, about a generally upright, slewing axis, to an elevating linkage mechanism of a vehicle;

(ii) power means for controlled slewing of the primary support structure about its slewing axis;

(iii) a secondary support structure rotatably mounted about a generally forwardly directed axis on the primary support structure;

(iv) power means to effect controlled rotation of the secondary support structure with respect to the primary support structure;

(v) tool support means pivotally mounted on the secondary support structure; and (vi) means to pivot the tool support means with respect to the secondary support structure.

13. A front end loader characterized in that a loading and tipping bucket—carried at front ends of a pair of parallel arms pivoted at their rear ends about a common horizontal pivot axis to the front end loader with the arms elevatable by rams in parallel vertical planes—is replaceable by a mechanism (22) for supporting an alternative and universal earthworking tool (31,47,54), the mechanism (22) comprising a king post structure (**24*a*) providing a generally upright, slewing axis (24), secured by structure (24*b*) to the front ends of said parallel arms (25) of the front end loader, which arms (25) together with hydraulic rams (50) provide an elevating linkage, and power means (26,27) to effect controlled slewing of the mechanism (22) about the slewing axis (24**).

14. A front end loader as claimed in claim 13, wherein the power means (26,27) to effect slewing consists of a double acting hydraulic ram (26,27).

15. A front end loader as claimed in claim 13, wherein the power means (26,27) to effect slewing consists of a pair of single acting hydraulic rams (26,27).

16. A front end loader as claimed in claim 13, wherein the parallel arms (25) include downwardly depending portions (**25*a*) so as to be generally of inverted "L"-shape, with upper and lower plates (24*b*) attached to the portions (25*a*) and spaced apart to secure the king post (24*a***) between them.

17. A mechanism (22) for fitting as an attachment to a conventional front end loader (21), characterised in that, the mechanism (22) comprises, in combination;

(i) a pair of parallel link arms (25) to replace the link arms of the conventional front end loader and with rear ends of the arms being adapted to be pivotable about the same pivot axes (**25*b***) on the loader, as the replaced conventional arms;

(ii) a pair of primary, parallel rams (**25*c*) pivotably connected at their rear ends (25*d*) to the front end loader (21) and at their front ends to one of the parallel link arms (25), so as to be capable of elevating and lowering the link arms (25) about their pivots (25*b***) in a generally vertical plane to provide a primary elevating and lowering facility;

(iii) a slewing axis (24) provided, by a king post structure (**24*a*) carried, commonly, by the front ends of the arms, and (iv) tool support structure (28) pivotally attached to the king post structure (24*a*), and (v) a pair of secondary parallel rams (34,35) pivotally connected between the king post structure (24*a*) and the tool support structure (28**), to provide a secondary elevating structure to provide a secondary elevating and lowering facility.

18. A mechanism (22) as claimed in claim 17, characterised in that, the primary link arms (25) are of inverted "L"-shape in side profile.

* * * * *